US007221892B2

(12) United States Patent
Sato

(10) Patent No.: US 7,221,892 B2
(45) Date of Patent: May 22, 2007

(54) DEVELOPING DEVICE USED IN IMAGE FORMING DEVICE

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 43 days.

(21) Appl. No.: 10/764,477

(22) Filed: Jan. 27, 2004

(65) Prior Publication Data

US 2004/0184843 A1 Sep. 23, 2004

(30) Foreign Application Priority Data

Jan. 28, 2003 (JP) ..... 2003-018914

(51) Int. Cl.
*G03G 15/08* (2006.01)

(52) U.S. Cl. ..... 399/283; 399/279; 399/285; 399/281

(58) Field of Classification Search ..... 399/279, 399/281, 283, 285
See application file for complete search history.

(56) References Cited

U.S. PATENT DOCUMENTS 4,930,438 A * 6/1990 Demizu et al. ..... 399/281
5,057,871 A * 10/1991 Hirose et al. ..... 399/283
5,223,668 A * 6/1993 Takaya et al. ..... 399/236
5,412,458 A * 5/1995 Kamaji et al. ..... 399/272
5,495,322 A * 2/1996 Wada et al. ..... 399/285
5,701,563 A * 12/1997 Fukuda et al. ..... 399/284
5,809,386 A * 9/1998 Iwata ..... 399/281
6,064,847 A * 5/2000 Iwamatsu et al. ..... 399/283
2002/0012552 A1* 1/2002 Furukawa et al. ..... 399/281

FOREIGN PATENT DOCUMENTS

JP A 5-297696 11/1993
JP B2 6-19630 3/1994
JP A 9-9696 1/1997
JP A 9-236979 9/1997
JP A 9-329963 12/1997
JP 2003005515 A * 1/2003
JP 2003114565 A * 4/2003

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

A developing device includes a removing roller positioned vertically above a supplying roller and in contact with a developing roller. Positively charged toner is supplied from the supplying roller to the developing roller and then supplied to a photosensitive drum for developing an electrostatic latent image thereon. Toner remaining on the developing roller that was not supplied to develop the latent image is removed by the removing roller. Some of the toner stripped by the removing roller falls down toward the supply roller and is again supplied to the developing roller.

20 Claims, 3 Drawing Sheets

DEVELOPING DEVICE USED IN IMAGE FORMING DEVICE

BACKGROUND OF THE INVENTION

1. Field of the Invention

The present invention relates to a developing device provided with a removing member that removes residual nonmagnetic single-component developer from a developer-carrying member, and an image-forming device including the developing device.

2. Related Art

One type of developing device well known in the art includes a developer-carrying member that develops an electrostatic latent image formed on an image-carrying member by supplying a charged nonmagnetic single-component developer to the surface of the image-carrying member, and a supplying member that supplies developer to the developer-carrying member. In this type of developing device, an image formation is performed in an electrophotographic method. That is, the supplying member supplies a nonmagnetic single-component developer, such as toner, accommodated in a toner-accommodating chamber or the like to the developer-carrying member while tribocharging the developer. A thickness-regulating member, such as a blade or the like, regulates the developer at a uniform thin layer. When the developer reaches a position across from the image-carrying member, the developer carried on the developer-carrying member is selectively deposited on an electrostatic latent image formed on the image-carrying member. Then, the nonmagnetic single-component developer deposited on the image-carrying member is transferred onto a recording medium, such as a recording paper.

However, a problem caused by what is called sleeve ghosting can occur when some of the developer is not supplied to the image-carrying member for developing the electrostatic latent image and remains on the surface of the developer-carrying member after passing by the position opposing the image-carrying member. Thereupon, Japanese unexamined patent application publication No. HEI-9-236979 proposes to provide a removing member on the upstream side of the supplying member in the rotational direction of the developer-carrying member to remove the developer that is not supplied for developing the latent image but remains on the surface of the developer-carrying member. The occurrence of sleeve ghosting can be satisfactorily prevented in this case since the developer is supplied from the supplying member to the developer-carrying member after first removing the residual developer from the developer-carrying member.

However, in the device disclosed in Japanese unexamined patent application publication No. HEI-9-236979, the developer-carrying member is rotated so that the peripheral surface of the developer-carrying member opposing the supplying member moves from bottom to top in relation to the direction of gravity, while the removing member is rotated such that the peripheral surface of the removing member opposing the developer-carrying member moves from top to bottom. Further, the removing member is disposed at the bottom section of a developing cartridge. Accordingly, toner removed by the removing member collects in a space between the removing member and a bottom surface of an outer case of the developing cartridge, which can have an adverse effect on toner circulation. A worsening in toner circulation can lead to such problems as a drastic reduction in image quality in parts of the formed image.

SUMMARY OF THE INVENTION

In view of the foregoing, it is an object of the present invention to overcome the above problems and also to provide a developing device including a removing member that removes nonmagnetic single-component developer remaining on the surface of a developer-carrying member that was not supplied for developing an electrostatic latent image. It is another object of the present invention to provide an image-forming device including the developing device that can effectively circulate developer removed by the developing device.

In order to achieve the above and other objects, the present invention provides a developing device including a developer-carrying member that conveys a charged nonmagnetic single-component developer to a surface of an image-carrying member, a supplying member that supplies a developer to the developer-carrying member, and a removing member that removes a charged nonmagnetic single-component developer remaining on a peripheral surface of the developer-carrying member that was not supplied to the image-carrying member. The developer-carrying member rotates in a rotational direction such that the peripheral surface of the developer-carrying member opposing the supplying member moves vertically downward. The removing member is positioned vertically above the supplying member and upstream of the supplying member in the rotational direction of the developer-carrying member.

There is also provided a developing device including a developer-carrying member that conveys a charged nonmagnetic single-component developer to a surface of an image-carrying member, a supplying member that supplies a developer to the developer-carrying member, and a removing member that removes a nonmagnetic single-component developer remaining on a peripheral surface of the developer-carrying member that was not supplied to the image-carrying member. The removing member is positioned upstream of the supplying member in the rotational direction of the developer-carrying member. The removing member rotates such that a peripheral surface of the removing member opposing the developer-carrying member moves in the same direction as the peripheral surface of the developer-carrying member opposing the removing member while in contact with the peripheral surface of the developer-carrying member.

There is also provided an image forming apparatus including an image-carrying member, a developer-carrying member that conveys a charged nonmagnetic single-component developer to a surface of the image-carrying member, a supplying member, formed of a conductive material, that supplies a developer to the developer-carrying member, a removing member, formed of a conductive material, that removes a charged nonmagnetic single-component developer remaining on a peripheral surface of the developer-carrying member that was not supplied to the image-carrying member, and a power source. The developer-carrying member rotates in a rotational direction such that the peripheral surface of the developer-carrying member opposing the supplying member moves vertically downward. The removing member is positioned vertically above the supplying member and upstream of the supplying member in the rotational direction of the developer-carrying member. A bias is applied by the power source to between the removing member and the developer-carrying member so as to attract the charged nonmagnetic single-component developer from the peripheral surface of the developer-carrying member to the removing member. A bias is applied by the power source to between the supplying member and the developer-carrying member so as to attract the charged nonmagnetic single-component developer from the supplying member to the developer-carrying member.

There is also provided an image forming apparatus including an image-carrying member, a developer-carrying member that conveys a charged nonmagnetic single-component developer to a surface of the image-carrying member, a supplying member, formed of a conductive material, that supplies a developer to the developer-carrying member, a removing member, formed of a conductive material, that removes a nonmagnetic single-component developer remaining on a peripheral surface of the developer-carrying member that was not supplied to the image-carrying member, and a power source. The removing member is positioned upstream of the supplying member in the rotational direction of the developer-carrying member. The removing member rotates such that a peripheral surface of the removing member opposing the developer-carrying member moves in the same direction as the peripheral surface of the developer-carrying member opposing the removing member while in contact with the peripheral surface of the developer-carrying member. The power source applies a bias to between the removing member and the developer-carrying member so as to attract the electrically-charged nonmagnetic single-component developer from the developer-carrying member to the removing member. The power source applies a bias to between the supplying member and the developer-carrying member so as to attract the electrically-charged nonmagnetic single-component developer from the supplying member to the developer-carrying member.

PREFERRED EMBODIMENTS OF THE PRESENT INVENTION

Figure 1:
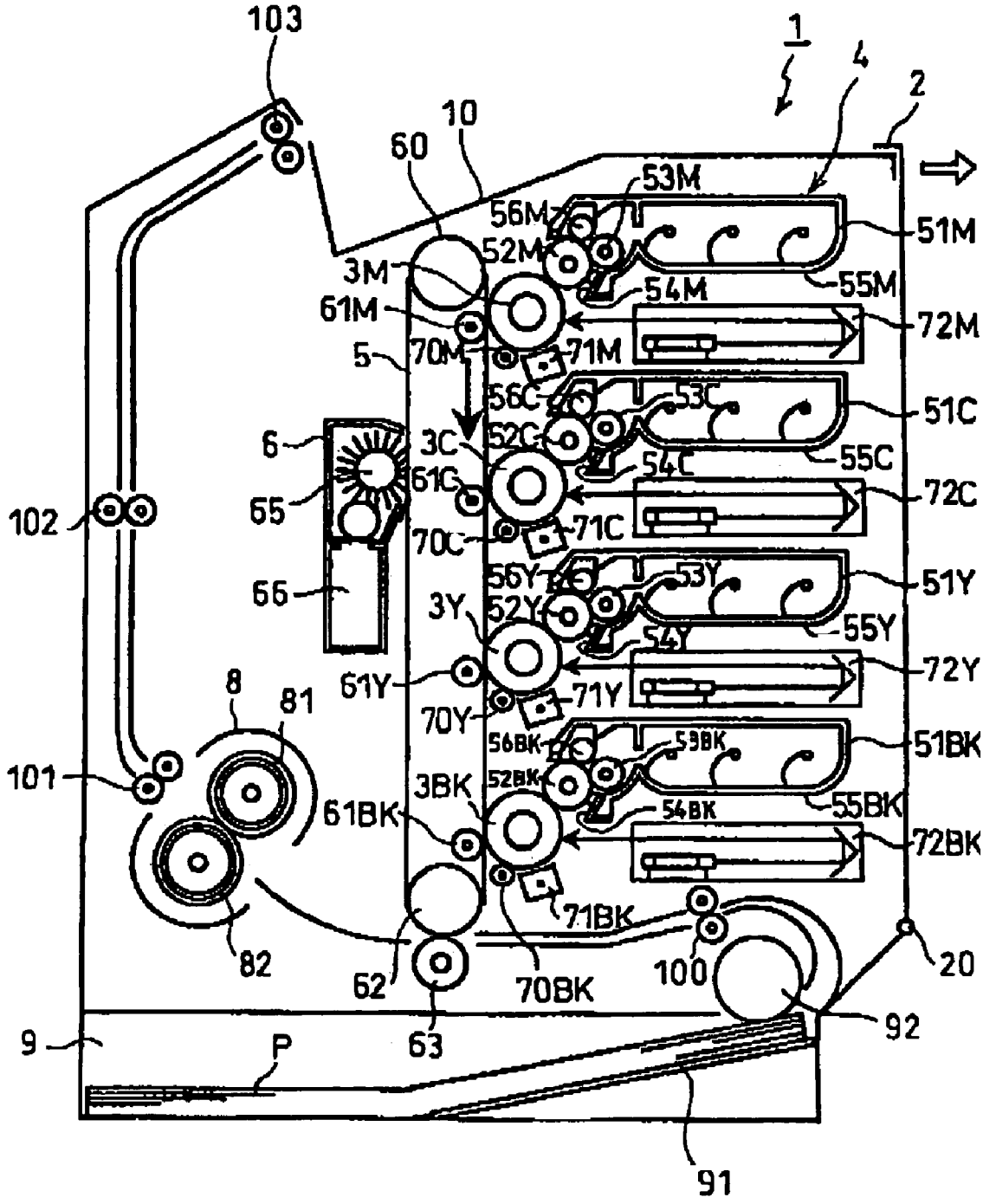
FIG. 1 is a side cross-sectional view showing the general construction of a color laser printer according to a first embodiment of the present invention.

A developing device and an image-forming device according to preferred embodiments of the present invention will be described while referring to the accompanying drawings. A first embodiment of the present invention will be described with reference to FIGS. 1 and 2. FIG. 1 is a side cross-sectional view showing the general construction of a color laser printer 1, which serves as the image-forming device to which the present invention is applied. The printer 1 shown in FIG. 1 includes a visible-image forming unit 4, a belt-shaped intermediate transfer member 5, a fixing unit 9, a paper supply unit 9, and a discharge tray 10.

For each step in forming visible images with toner of the colors magenta (M), cyan (C), yellow (Y), and black (Bk), the visible-image forming unit 4 includes developing units 51M, 51C, 51Y, and 51Bk (collectively referred to as "developing units 51"), photosensitive drums 3M, 3C, 3Y, and 3Bk (collectively referred to as "photosensitive drums 3"), cleaning rollers 70M, 70C, 70Y, and 70Bk (collectively referred to as "cleaning rollers 70"), "charging units 71M, 71C, 71Y, and 71Bk (collectively referred to as charging units 71"), and exposure devices 72M, 72C, 72Y, and 72Bk (collectively referred to as "exposure devices 72").

The aforementioned components will be described in greater detail. While the developing unit 51M is shown as an example in FIG. 2, the constructions of the developing units 51C, 51Y, and 51Bk are identical.

First, the developing unit 51M will be described. It should be noted that since the developing units 51M, 51C, 51Y, and 51Bk are identical, only the developing unit 51M will be described, and description of developing units 51C, 51Y, and 51Bk will be omitted to avoid duplication in explanation.

The developing unit 51M includes a developing roller 52M and a supply roller 53M. The developing roller 52M is formed in a cylindrical shape with a conductive silicon rubber as the base material, the surface of which is coated with a resin or a rubber material containing fluorine. However, the developing roller 52M need not be configured of a conductive silicon rubber as the base material, but instead may be configured of a conductive urethane rubber. The average roughness (Rz) at ten points on the surface of the developing roller 52M should be set to 3–5 μm in order to be smaller than the average particle size of toner, which is 9 μm.

The supply roller 53M is formed of a conductive sponge roller and is configured to contact the developing roller 52M with pressure applied by the elastic force of the sponge. The supply roller 53M can be configured of an appropriate foam member formed of a conductive silicon rubber, EPDM, or urethane rubber.

Figure 2:
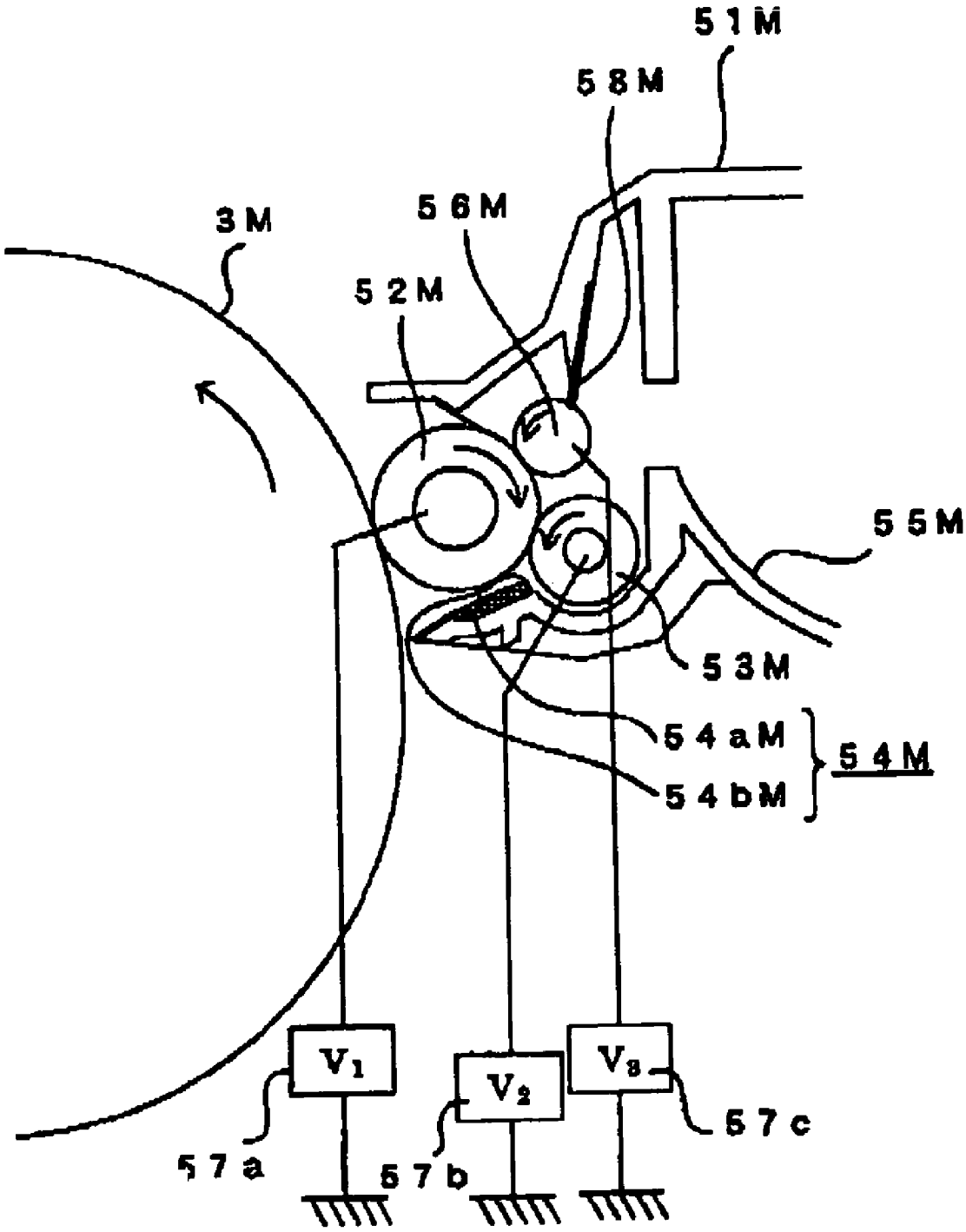
FIG. 2 is an enlarged view showing the construction of a developing device in the color laser printer of FIG. 1.

The developing unit 51M also includes a thickness-regulating blade 54M and a removing roller 56M. As shown in FIG. 2, the thickness-regulating blade 54M includes a support part 54*a*M and a contact part 54*b*M. The support part 54*a*M is formed of stainless steel with the base end fixed to a developing case 55M. The contact part 54*b*M is formed of an insulating silicon rubber or an insulating rubber or synthetic resin containing fluorine. The contact part 54*b*M is provided on the other end of the support part 54*a*M extending above the base end. The contact part 54*b*M contacts the developing roller 52M from the bottom side with pressure applied by the elastic force of the support part 54*a*M.

The removing roller 56M contacts the developing roller 52M at a position above the supply roller 53M in the gravitational direction. The removing capacity of the removing roller 56M described later can be improved by configuring the removing roller 56M of a solid conductive roller or a metal roller. However, conductive foam, such as silicon or urethane, can also be used.

Toner accommodated in the developing case 55M is a positively charging nonmagnetic single-component developer. The toner includes base toner particles having an average size of 9 μm. The base toner particles are formed by adding an additive, such as carbon black, well known in the art and a charge-controlling agent or charge-controlling resin, such as nigrosine, triphenylmethane, or quaternary ammonium salt, to a styrene-acrylic resin formed in a spherical shape through suspension polymerization. The toner is configured by adding silica to the surface of the base toner particles. The silica additive undergoes hydrophobing according to a process known in the art using a silane coupling agent, silicon oil, or the like. The average particle size of the silica is 10 nm, with the additive accounting for a 0.6% of the base toner particle weight. Toner of the colors magenta, cyan, yellow, and black are accommodated in the developing cases 55M, 55C, 55Y, and 55Bk, respectively.

The toner is a suspension polymerized toner very nearly spherical in shape. Also, the hydrophobed silica having an average particle size of 10 nm has been added to the particles at 0.6% weight therefore, the toner has excellent fluidity, and a sufficient charge amount Can be obtained by tribocharging. Further, since the toner has no sharp edges like coarsely ground toner, the particles are less affected by mechanical forces and readily follow the electric field, thereby achieving efficient transfer.

As shown in FIG. 2, the photosensitive drum 3M rotates in the counterclockwise direction in the drawing, while the developing roller 52M rotates in the clockwise direction. Further, the removing roller 56M and the supply roller 53M both rotate in the counterclockwise direction in the drawing. Hence, in the present embodiment, the developing rollers 52 (52M, 52C, 52Y, 52Bk), the supply rollers 53 (53M, 53C, 53Y, 53Bk) and the removing rollers 56 (56M, 56C, 56Y, 56Bk) rotate such that their peripheral surfaces at the points of contact move in the same direction. The velocity ratios of corresponding peripheral surfaces at the points of contact are set between 0.7 and 1.3.

DC power sources 57*a*, 57*b*, and 57*c* are provided to apply biases to the developing rollers 52, the supply rollers 53, and the removing rollers 56, respectively. The DC power source 57*a* applies a voltage V1 to the developing rollers 52. The DC power source 57*b* supplies a voltage V2 to the supply rollers 53. The DC power source 57*c* supplies a voltage V3 to the removing rollers 56. When the toner is charged to a positive polarity, the voltages V1, V2, and V3 have the relationship V3<V1<V2. Hence, the positively charged toner is supplied from the supply rollers 53 to the developing rollers 52. After the toner is formed in a uniform thin layer on the developing rollers 52 by the thickness-regulating blades 54 (54M, 54C, 54Y, 54Bk), the toner is supplied from the developing rollers 52 to electrostatic latent images described later that are formed on the photosensitive drums 3. Toner remaining on the developing rollers 52 that was not supplied for developing the electrostatic latent images is scraped off the developing rollers 52 by the removing rollers 56.

The developing case 55M is provided with a scraper 58M for scraping off toner deposited on the surface of the removing roller 56M. The scraper 58M can achieve sufficient scraping capacity when formed of a synthetic resin film, such as PET, a urethane rubber, or a urethane sponge of approximately 200 μm thick.

The photosensitive drums 3 are formed, for example, of an aluminum base covered by a positively charged photosensitive layer. The photosensitive layer is formed at a thickness of 20 μm or greater. Further, the aluminum base is used as a grounding layer. In the present embodiment, the photosensitive drums 3 rotate at a different velocity from the intermediate transfer member 5.

Returning to FIG. 1, the cleaning rollers 70 are formed of conductive materials, such as a conductive sponge, and are disposed below the corresponding photosensitive drums 3 in sliding contact with the same. A power source not shown in the drawings applies a voltage of negative polarity, the opposite polarity from the toner, to the cleaning rollers 70. The cleaning rollers 70 remove residual toner on the photosensitive drums 3 by the frictional force on the photosensitive drums 3 and the effects of the electric field generated by the above voltages. Since the present embodiment employs a cleanerless developing method, residual toner removed from the cleaning rollers 70 is once again returned to the photosensitive drums 3 within a prescribed cycle after the developing process has been completed.

The charging units 71 are Scorotron-type charging devices and confront the surfaces of the photosensitive drums 3 from the bottoms thereof at a position downstream from the cleaning rollers 70 in the rotational direction of the photosensitive drums 3. Roller-type charging devices that contact the photosensitive drums 3 may also be used as the charging units 71.

The exposure devices 72 are each configured of a laser scanner unit well known in the art and are positioned downstream from the charging units 71 in the rotational direction of the photosensitive drums 3 in order to irradiate laser light onto the surfaces of the photosensitive drums 3. The exposure devices 72 irradiate laser light beams onto the surfaces of the photosensitive drums 3 based on image data so as to form electrostatic latent images for each color on the surfaces of the photosensitive drums 3.

This construction effectively develops positively charged latent images formed on the photosensitive drums 3 with the positively charged toner according to a reverse developing method in which the positively-charged toner is attracted to positively-charged areas of the photosensitive drums 3 at points of contact between the developing rollers 52 and the photosensitive drums 3, thereby forming an image of very high quality.

The intermediate transfer member 5 is a conductive sheet formed of polycarbonate, polyimide, or the like that is configured in a belt shape. As shown in FIG. 1, the intermediate transfer member 5 is looped around two drive rollers 60 and 62. Intermediate transfer rollers 61M, 61C, 61Y, and 61Bk are disposed near positions opposing the photosensitive drums 3M, 3C, 3Y, and 3Bk. The surface of the intermediate transfer member 5 on the side opposing the photosensitive drums 3 moves vertically downward, as shown in FIG. 1.

A prescribed voltage is applied to the intermediate transfer rollers 61 in order to transfer toner deposited on the photosensitive drums 3 to the intermediate transfer member 5. A secondary transfer roller 63 is disposed at the position in which the toner image is transferred to a paper P, that is, opposite the drive roller 62 disposed at the lower end of the intermediate transfer member 5. A prescribed potential is applied to the secondary transfer roller 63, so that a four-color toner image carried on the intermediate transfer member 5 is transferred onto the paper P.

As shown in FIG. 1, a cleaning unit 6 is disposed on the opposite side of the intermediate transfer member 5 from the photosensitive drums 3. The cleaning unit 6 includes a scraping device 65 and a case 66. Toner remaining on the intermediate transfer member 5 is scraped off by the scraping device 65 and accumulates in the case 66.

The fixing unit 8 includes first and second heating rollers 81 and 82. A paper P carrying a four-color toner image is heated and compressed by the first and second heating rollers 81 and 82 while being conveyed therebetween, thereby fixing the toner image to the paper P.

The paper supply unit 9 is disposed on the bottom of the printer 1 and includes a loading tray 91 for accommodating the stacked paper P and a pickup roller 92 for feeding the paper P. The paper supply unit 9 feeds the paper P at a prescribed timing in relation to the image forming process performed by the exposure devices 72, the visible-image forming unit 4, the photosensitive drums 3, and the intermediate transfer member 5. A pair of conveying rollers 100 conveys the paper P fed by the paper supply unit 9 to the nip point between the intermediate transfer member 5 and the secondary transfer roller 63.

The discharge tray 10 is disposed at the top of the printer 1 and at the discharge end of the fixing unit 8. The discharge tray 10 accommodates paper P discharged from the fixing unit 8 and conveyed by pairs of conveying rollers 101, 102, and 103.

In the present embodiment, a front cover 2 is configured to swing open about a shaft 20 in the direction indicated by an arrow in FIG. 1. By opening the front cover 2, the developing units 51 can be easily replaced.

Next, the operations of the printer 1 according to the present embodiment will be described. First, the charging units 71 apply a uniform charge to the photosensitive layers on the photosensitive drums 3. Next, these photosensitive layers are exposed to the exposure devices 72 based on the image data for the colors magenta, cyan, yellow, and black. The developing units 51M, 51C, 51Y, and 51Bk deposit magenta toner, cyan toner, yellow toner, and black toner on the electrostatic latent images formed on the photosensitive layers of the corresponding photosensitive drums 3M, 3C, 3Y, and 3Bk to develop the magenta, cyan, yellow, and black colors of the image. The toner images in magenta, cyan, yellow, and black that formed in this way are temporarily transferred onto the surface of the intermediate transfer member 5.

Next, toner remaining on the photosensitive drums 3 following the transfer is temporarily retained by the cleaning rollers 70. The toner image for each color is formed at slightly different times with consideration for the velocity of the intermediate transfer member 5 and the positions of the photosensitive drums 3 in order to superimpose the toner images of each color on the intermediate transfer member 5 during the transfer process.

The four-color toner image formed on the intermediate transfer member 5 as described above is transferred to the paper P fed from the paper supply unit 9 at the nip point between the secondary transfer roller 63 and the intermediate transfer member 5. After the toner image is fixed to the paper P in the fixing unit 8, the paper P is discharged onto the discharge tray 10. Hence, a four-color image is formed on the paper P according to this process.

Further, in the developing units 51 described above, positively charged toner is supplied from the supply rollers 53 to the developing rollers 52 and, after the thickness-regulating blades 54 regulate the toner at a uniform thin layer, is supplied to the photosensitive drums 3 for developing electrostatic latent images formed thereon. Toner remaining on the developing rollers 52 that was not supplied for developing the latent images is subsequently stripped from the developing rollers 52 by the removing rollers 56.

The removing rollers 56 are disposed upstream of the supply rollers 53 in the rotational direction of the developing rollers 52 and are disposed higher than the supply rollers 53 while overlapping the same vertically (see FIG. 2). A portion of the toner stripped by the removing rollers 56 falls down toward the supply rollers 53 and is again supplied to the developing rollers 52 by the supply rollers 53. Accordingly, the printer 1 of the present embodiment can effectively circulate toner.

That is, when the stripped toner collects in portions of the developing cases 55 (55M, 55C, 55Y, 55Bk), the quality in parts of the formed images may decline radically. However, by circulating the toner as described above in the present embodiment, it is possible to form high-quality images. Moreover, since the Scrapers 58 (58M, 58C, 58Y, 58Bk) scrape off toner adhering to the surfaces of the removing rollers 56 in the present embodiment, removal of toner by the removing rollers 56 can be performed more effectively and stably, enabling the removing rollers 56 to maintain a stable toner removing capability to further suppress the generation of sleeve ghosting.

The scrapers 58 are disposed such that the point of contact between the scrapers 58 and the removing rollers 56 is above and vertically overlapping the supply rollers 53. Accordingly, toner removed from the removing rollers 56 by the scrapers 58 falls down toward the supply rollers 53 and is again supplied to the developing rollers 52. Accordingly, the printer 1 of the present embodiment can more effectively circulate toner.

In the present embodiment, the removing rollers 56 and developing rollers 52 rotate such that their peripheral surfaces at the point of confrontation move in the same direction while contacting one another. Further, velocity ratios of peripheral surfaces on each of the developing rollers 52, the supply rollers 53, and the removing rollers 56 opposing one another are set at 0.7–1.3. Accordingly, the frictional force applied to the toner is not large, effectively suppressing the degradation of toner, such as degradation caused by the additives becoming embedded in the base toner particles. (The frictional force applied to the toner increases as the velocity ratio of the contacting surfaces on the removing rollers 56 and the developing rollers 52 becomes farther from 1.) Moreover, the removing rollers 56 are configured of a conducting material, and biases are applied to all of the rollers 52, 53, and 56 to attract toner from the developing rollers 52 onto the removing rollers 56. Accordingly, toner on the developing rollers 52 can be stripped by the removing rollers 56 using an electrostatic force. Since opposing peripheral surfaces 20 of the removing rollers 56 and the developing rollers 52 move in the same direction, as described above, residual toner can be effectively removed, further suppressing the generation of sleeve ghosting, further decreasing the frictional force and the like that must be applied to remove residual toner, and thereby suppressing the degradation of toner. Further, toner can be smoothly and effectively supplied from the supply rollers 53 to the developing rollers 52, effectively preventing the blurring or fading of images and the like.

Further, according to the present embodiment, the surface of the intermediate transfer member 5 opposing the photosensitive drums 3 moves vertically downward, while the secondary transfer roller 63 transfers the toner image to the paper P at the bottom end of the intermediate transfer member 5. Accordingly, the paper supply unit 9 can be disposed in the bottom section of the printer 1, reducing the footprint of the printer 1. Moreover, when positioning the paper supply unit 9 in the bottom section of the printer 1, the printer 1 has advantages over devices that provide cassette-type units in the top of the device, for example, as in the ease of loading the paper P. Further, as shown in FIG. 1, the conveying path of the paper P to the secondary transfer roller 63 can be shortened, thereby shortening the time required to complete the printing operation.

Further, since toner in the present embodiment is formed through a polymerization method, as described above, the toner has excellent fluidity, thereby more effectively preventing the accumulation of toner. Moreover, since the polymer toner has excellent fluidity, there is little decline in image quality, even when performing two transfer processes using the intermediate transfer member 5 of the present embodiment. Since there is less residual toner after a transfer using polymer toner, such residual toner can be reliably removed when using a cleanerless developing system. Use of a cleanerless developing system also eliminates the space required for a waste toner receptacle, thereby reducing the overall size of the printer 1.

Further, in the present embodiments the paper supply unit 9; the processing unit including the intermediate transfer member 5, the photosensitive drums 3, and the developing units 51; and the discharge tray 10 can be disposed in a vertically overlapping configuration in the order of the paper supply unit 9, the processing unit, and the discharge tray 10 from bottom to top. Accordingly, parts protruding from the main body of the printer 1 can be eliminated thereby reducing the footprint of the printer 1.

Figure 3:
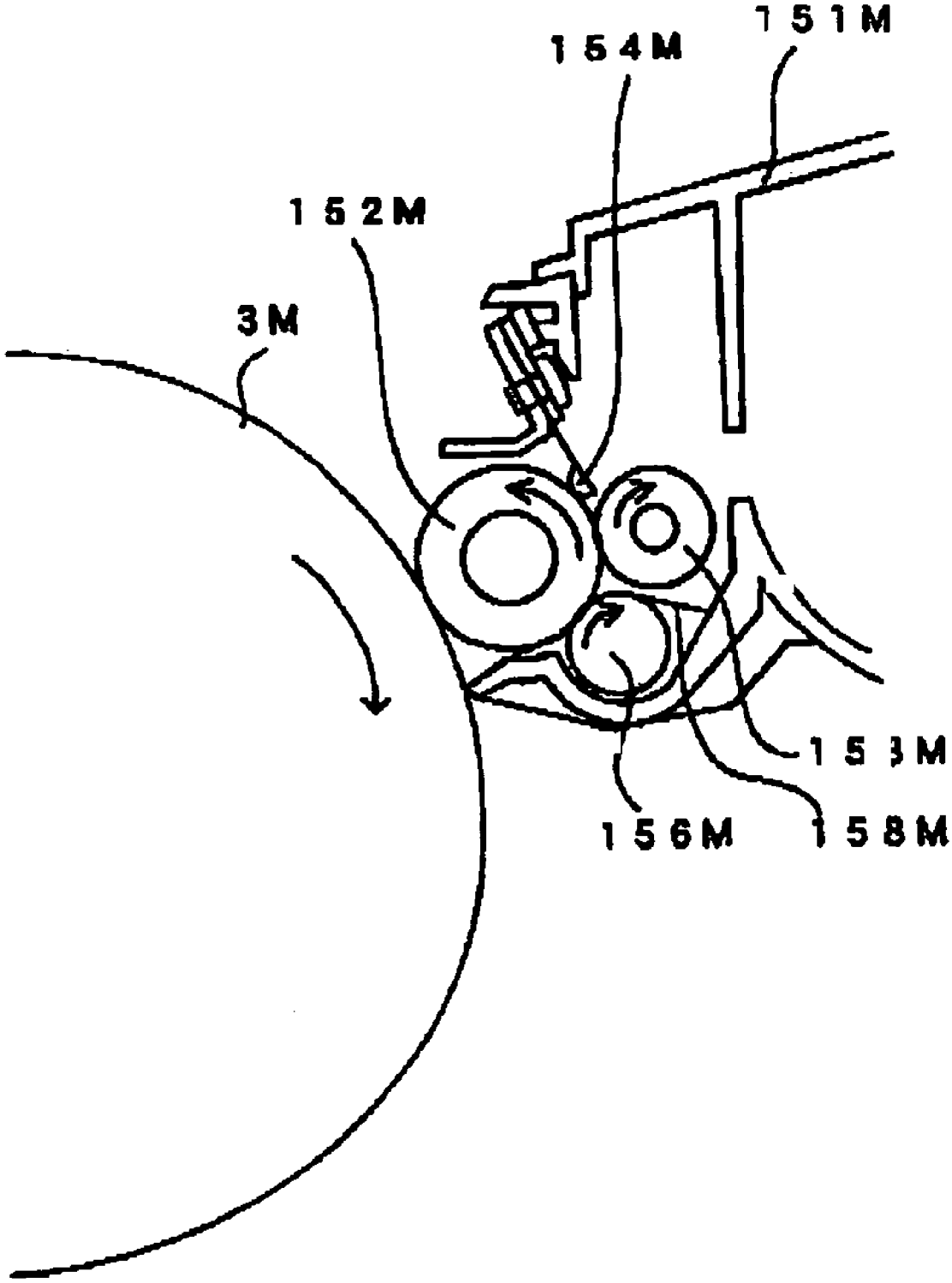
FIG. 3 is an enlarged view showing the construction of a developing device according to a second embodiment of the present invention.

FIG. 3 is an enlarged view showing the relative parts of a developing unit 181M according to a second embodiment of the present invention. The developing unit 151M can be applied to devices in which the photosensitive drum 3M rotates in the clockwise direction of the drawing. An image-forming device in which the photosensitive drum 3M rotates in this way can be easily understood by imagining the pickup roller 92 of the printer 1 in FIG. 1 being disposed on the left side of the drawing.

The developing unit 151M is provided with a developing roller 152M and a removing roller 156M disposed below the developing roller 152M. A supplying roller 153M and a thickness-regulating blade 154M are disposed in sequence downstream from the removing roller 156M in the rotational direction of the developing roller 152M. The constructions of the developing roller 152M, the supplying roller 153M, the thickness-regulating blade 154M, and the removing roller 156M are identical to the developing roller 52M, the supply roller 53M, the thickness-regulating blade 54M, and the removing roller 56H described above, and the same biases are applied to each. Further, the developing roller 152M, supplying roller 153M, and the removing roller 156M of the second embodiment rotate such that the peripheral surfaces of each at points of confrontation move in the same direction at a velocity ratio of 0.7–1.3. Hence, the developing roller 152M rotates in the counterclockwise direction of the drawing, while the supplying roller 153M and the removing roller 156M rotate in the clockwise direction. A scraper 158M is also provided on a developing case. The scraper 158M contacts the top surface of the removing roller 156M.

In the present embodiment having the above construction, a portion of the toner scraped off by the removing roller 156M is conveyed downstream in the rotational direction of the developing roller 152M and resupplied to the developing roller 152M by the supplying roller 153M disposed at a position vertically overlapping the removing roller 156M. Remaining portion of the toner scraped off by the scraper 158M accumulates at the position and reaches the supplying roller 153M when the accumulated toner reaches a certain amount, so that the toner is resupplied to the developing roller 152M by the supplying roller 153M. Hence, the present embodiment can effectively circulate toner that has been removed. Further, in the present embodiment, the velocity ratios of the peripheral surfaces on the rollers and the biases applied thereto are set to the same, values described in the first embodiment. Hence, this construction can achieve the same effects as the first embodiment. That is, the second embodiment can effectively suppress the degradation of toner and moreover can more effectively suppress the generation of sleeve ghosting and can effectively prevent blurred images and the like. While FIG. 3 shows the developing unit 151M, it is obvious that the cyan developing unit, the yellow developing unit, and the black developing unit can be similarly configured.

In the embodiments described above, the lengths (widths) of the rollers 52, 53, 56, 152M, 153M, and 156M with respect to their axial direction should be set to achieve the relationship: (image forming range of the photosensitive drum 3)<(width of the removing roller 56, 156M)=(width of a developing chamber inside the developing unit 51, 151M)<(width of the developing roller 52, 152M) With this construction, image formation can be performed more effectively.

In the present invention, the removing roller is disposed upstream of the supplying roller in the rotational direction of the developing roller. Moreover, the removing roller and the developing roller rotate such that their peripheral surfaces at the point of confrontation move in the same direction while in contact with each other. Accordingly, toner removed by the removing roller is conveyed to the downstream side in the rotational direction of the developing roller and supplied again to the developing roller by the supplying roller. Accordingly, the present invention can effectively circulate the nonmagnetic single-component developer that has been removed.

While the invention has been described in detail with reference to specific embodiments thereof, it would be apparent to those skilled in the art that many modifications and variations may be made therein without departing from the spirit of the invention, the scope of which is defined by the attached claims.

For example, in the embodiments described above, the developing member, the supplying members, and the removing members are each configured of a roller, but can also be configured of a sleeve or belt. Further, the removing roller can be a fixed member rather than one that rotates, such as a plate-shaped scraper. Further, the developing device and image-forming device of the present invention can be applied to black-ink or single-color image-forming devices. Further, the nonmagnetic single-component developer may also be a negatively charged type, in which case the voltages V1–V3 should be set such that V3>V1≧V2.

What is claimed is:

1. A developing device, comprising:

a developer-carrying member that conveys a charged nonmagnetic single-component developer to a surface of an image-carrying member;

a supplying member that supplies a developer to the developer-carrying member;

a removing member that removes a charged nonmagnetic single-component developer remaining on a peripheral surface of the developer-carrying member that was not supplied to the image-carrying member; and a removing device that removes the charged nonmagnetic single-component developer from the removing member, the removing device being arranged to contact the removing member, wherein:

the developer-carrying member rotates in a rotational direction such that the peripheral surface of the developer-carrying member opposing the supplying member moves vertically downward;

the removing member is positioned vertically above the supplying member and upstream of the supplying member in the rotational direction of the developer-carrying member;

the removing member rotates such that a peripheral surface of the removing member opposing the developer-carrying member moves in the same direction as the peripheral surface of the developer-carrying member opposing the removing member at a contact position with the peripheral surface of the developer-carrying member; and a bias is applied to the removing member and the developer-carrying member so as to attract the charged nonmagnetic single-component developer from the peripheral surface of the developer-carrying member onto the removing member, wherein the removing member is formed of a conductive material.

2. The developing device according to claim 1, wherein the removing member rotates such that a peripheral surface of the removing member opposing the developer-carrying member moves in the same direction as the peripheral surface of the developer-carrying member opposing the removing member while in contact with the peripheral surface of the developer-carrying member.

3. The developing device according to claim 1, wherein the removing member rotates and has a peripheral surface, and a velocity ratio of the peripheral surfaces of the removing member and the developer-carrying member is 0.7–1.3.

4. The developing device according to claim 1, wherein:

the supplying member rotates such that a peripheral surface of the supplying member opposing the developer-carrying member moves in the same direction as the peripheral surface of the developer-carrying member opposing the supplying member;

a velocity ratio of the peripheral surfaces of the supplying member and the developer-carrying member is 0.7–1.3.

5. The developing device according to claim 4, wherein the supplying member is formed of a conductive material, and the supplying member and the developer-carrying member have the same potential.

6. The developing device according to claim 1, wherein:

the supplying member rotates such that a peripheral surface of the supplying member opposing the developer-carrying member moves in the same direction as the peripheral surface of the developer-carrying member opposing the supplying member;

a velocity ratio of the peripheral surfaces of the supplying member and the developer-carrying member is 0.7–1.3;

the supplying member is formed of a conductive material;

the supplying member and the developer-carrying member have the same potential; and a bias is applied to between the supplying member and the developer-carrying member so as to attract the charged nonmagnetic single-component developer from the supplying member to the developer-carrying member.

7. The developing device according to claim 1, further comprising a thickness-regulating member that is disposed downstream of the supplying member in the rotational direction of the developer-carrying member, the thickness-regulating member regulates a thickness of the charged-nonmagnetic single-component developer carried on the developer-carrying member.

8. The developing device according to claim 1, wherein the removing device is a blade that scrapes off the charged nonmagnetic single-component developer.

9. A developing device, comprising:

a developer-carrying member that conveys a charged nonmagnetic single-component developer to a surface of an image-carrying member;

a supplying member that supplies a developer to the developer-carrying member;

a removing member that removes a nonmagnetic single-component developer remaining on a peripheral surface of the developer-carrying member that was not supplied to the image-carrying member; and a removing device that removes the charged nonmagnetic single-component developer from the removing member, the removing device being arranged to contact the removing member, wherein:

the removing member is positioned upstream of the supplying member in the rotational direction of the developer-carrying member;

the removing member rotates such that a peripheral surface of the removing member opposing the developer-carrying member moves in the same direction as the peripheral surface of the developer-carrying member opposing the removing member at a contact position with the peripheral surface of the developer-carrying member, wherein the removing member is formed of a conductive material; and a bias is applied to the removing member and the developer-carrying member so as to attract the electrically-charged nonmagnetic single-component developer from the developer-carrying member onto the removing member.

10. The developing device according to claim 9, wherein a velocity ratio of the peripheral surfaces of the removing member and the developer-carrying member is 0.7–1.3.

11. The developing device according to claim 9, wherein the supplying member rotates such that a peripheral surface of the supplying member opposing the developer-carrying member moves in the same direction as the peripheral surface of the developer-carrying member opposing the supplying member, and a velocity ratio of the peripheral surfaces of the supplying member and the developer-carrying member is 0.7–1.3.

12. The developing device according to claim 11, wherein the supplying member is formed of a conductive material, and the supplying member and the developer-carrying member have the same potential.

13. The developing device according to claim 9, wherein:

the supplying member rotates such that a peripheral surface of the supplying member opposing the developer-carrying member moves in the same direction as the peripheral surface of the developer-carrying member opposing the supplying member;

a velocity ratio of the peripheral surfaces of the supplying member and the developer-carrying member is 0.7–1.3;

the supplying member is formed of a conductive material;

the supplying member and the developer-carrying member have the same potential; and a bias is applied to between the supplying member and the developer-carrying member so as to attract the electrically-charged nonmagnetic single-component developer from the supplying member to the developer-carrying member.

14. The developing device according to claim 9, further comprising a thickness-regulating member that is disposed downstream of the supplying member in the rotational direction of the developer-carrying member, the thickness-regulating member regulating a thickness of a developer carried on the developer-carrying member.

15. The developing device according to claim 9, wherein the removing device is a blade that scrapes off the charged nonmagnetic single-component developer.

16. An image forming apparatus, comprising:

an image-carrying member;

a developer-carrying member that conveys a charged nonmagnetic single-component developer to a surface of the image-carrying member;

a supplying member, formed of a conductive material, that supplies a developer to the developer-carrying member;

a removing member, formed of a conductive material, that removes a charged nonmagnetic single-component developer remaining on a peripheral surface of the developer-carrying member that was not supplied to the image-carrying member;

a removing device that removes the charged nonmagnetic single-component developer from the removing member, the removing device being arranged to contact the removing member; and a power source; wherein:

the developer-carrying member rotates in a rotational direction such that the peripheral surface of the developer-carrying member opposing the supplying member moves vertically downward;

the removing member is positioned vertically above the supplying member and upstream of the supplying member in the rotational direction of the developer-carrying member;

the removing member rotates such that a peripheral surface of the removing member opposing the developer-carrying member moves in the same direction as the peripheral surface of the developer-carrying member opposing the removing member at a contact position with the peripheral surface of the developer-carrying member;

a bias is applied by the power source to the removing member and the developer-carrying member so as to attract the charged nonmagnetic single-component developer from the peripheral surface of the developer-carrying member onto the removing member; and a bias is applied by the power source to the supplying member and the developer-carrying member so as to attract the charged nonmagnetic single-component developer from the supplying member to the developer-carrying member.

17. The image forming apparatus according to claim 16, wherein the removing device is a blade that scrapes off the charged nonmagnetic single-component developer.

18. An image forming apparatus, comprising:

an image-carrying member;

a developer-carrying member that conveys a charged nonmagnetic single-component developer to a surface of the image-carrying member;

a supplying member, formed of a conductive material, that supplies a developer to the developer-carrying member;

a removing member, formed of a conductive material, that removes a nonmagnetic single-component developer remaining on a peripheral surface of the developer-carrying member that was not supplied to the image-carrying member;

a removing device that removes the charged nonmagnetic single-component developer from the removing member, the removing device being arranged to contact the removing member; and a power source, wherein:

the removing member is positioned upstream of the supplying member in the rotational direction of the developer-carrying member;

the removing member rotates such that a peripheral surface of the removing member opposing the developer-carrying member moves in the same direction as the peripheral surface of the developer-carrying member opposing the removing member at a contact position with the peripheral surface of the developer-carrying member;

the power source applies a bias to the removing member and the developer-carrying member so as to attract the electrically-charged nonmagnetic single-component developer from the developer-carrying member onto the removing member; and the power source applies a bias to the supplying member and the developer-carrying member so as to attract the electrically-charged nonmagnetic single-component developer from the supplying member to the developer-carrying member.

19. A developing device comprising:

a developer-carrying member that conveys a charged nonmagnetic single-component developer to a surface of an image-carrying member;

a supplying member that supplies a developer to the developer-carrying member;

a removing member that removes a charged nonmagnetic single-component developer remaining on a peripheral surface of the developer-carrying member that was not supplied to the image-carrying member; and a thickness-regulating member that regulates a developer into a uniform thin layer; wherein the developer-carrying member rotates in a rotational direction such that the peripheral surface of the developer-carrying member opposing the supplying member moves vertically downward;

the supplying member is positioned upstream of the thickness-regulating member in the rotational direction of the developer-carrying member;

the removing member is positioned vertically above the supplying member, the removing member is positioned upstream of the supplying member and upstream of the thickness-regulating member in the rotational direction of the developer-carrying member; and the thickness-regulating member is positioned below the developer-carrying member.

20. A developing device comprising:

a developer-carrying member that conveys a charged nonmagnetic single-component developer to a surface of an image-carrying member;

a supplying member that supplies a developer to the developer-carrying member;

a removing member that removes a nonmagnetic single-component developer remaining on a peripheral surface of the developer-carrying member that was not supplied to the image-carrying member; and a thickness-regulating member that regulates a developer into a uniform thin layer, wherein the supplying member is positioned upstream of the thickness-regulating member in the rotational direction of the developing-carrying member;

the removing member is positioned upstream of the supplying member and upstream of the thickness-regulating member in the rotational direction of the developer-carrying member;

the removing member rotates such that a peripheral surface of the removing member opposing the developer-carrying member moves in the same direction as the peripheral surface of the developer-carrying member opposing the removing member while the contact with the peripheral surface of the developer-carrying member;

the thickness-regulating member is positioned below the developer-carrying member.

* * * * *